United States Patent [19]

O'Brien

[11] Patent Number: 4,830,318

[45] Date of Patent: May 16, 1989

[54] DISPLAY STAND

[75] Inventor: Paul O'Brien, Anaheim, Calif.

[73] Assignee: O.B.I. Inc., Anaheim, Calif.

[21] Appl. No.: 210,974

[22] Filed: Jun. 24, 1988

[51] Int. Cl.[4] ..... F16M 11/32

[52] U.S. Cl. ..... 248/165; 40/606

[58] Field of Search ..... 248/165; 116/63 P, 63 R; 403/245, 246, 264; 40/606, 610, 612; 211/189, 204, 182, 190

[56] References Cited

U.S. PATENT DOCUMENTS

| | | | |
|---|---|---|---|
| 2,454,648 | 11/1948 | Green | 40/606 X |
| 3,950,873 | 4/1976 | Stehle | 40/606 |
| 4,126,288 | 11/1978 | De Sisto | 211/182 X |
| 4,144,664 | 3/1979 | Korte | 40/610 X |
| 4,162,013 | 7/1979 | Tucker | 211/189 X |
| 4,280,294 | 7/1981 | Eckberg | 40/606 |
| 4,357,772 | 11/1982 | Amick | 40/606 X |
| 4,380,298 | 4/1983 | Harig | 211/189 |
| 4,520,584 | 6/1985 | Howard | 40/606 |
| 4,655,352 | 4/1987 | Noyes | 211/175 X |
| 4,657,149 | 4/1987 | Masson | 211/189 X |

*Primary Examiner*—J. Franklin Foss

*Attorney, Agent, or Firm*—Poms, Smith, Lande & Rose

[57] ABSTRACT

A knockdown display stand for presenting a display board in a generally upright position. The board is retained to the stand but quickly and easily removable therefrom. The stand has a pair of spaced Y-shaped base members, the shorter legs resting on the floor with the longer leg upright. A tube interconnects the two spaced base members and the uprights each have vertical channels for receiving the board therein.

12 Claims, 4 Drawing Sheets

Fig. 10.
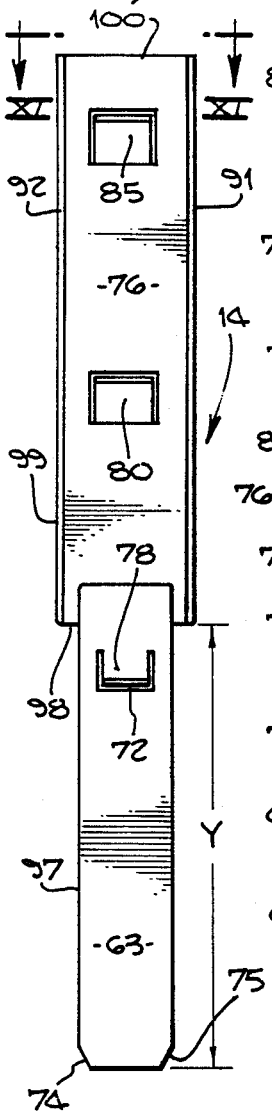
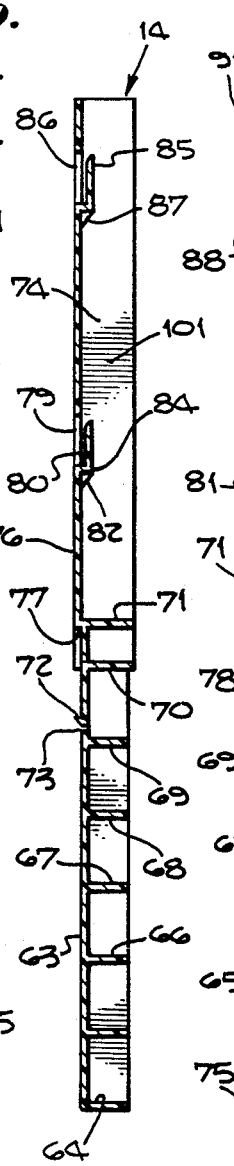
Fig. 9.
Fig. 8.
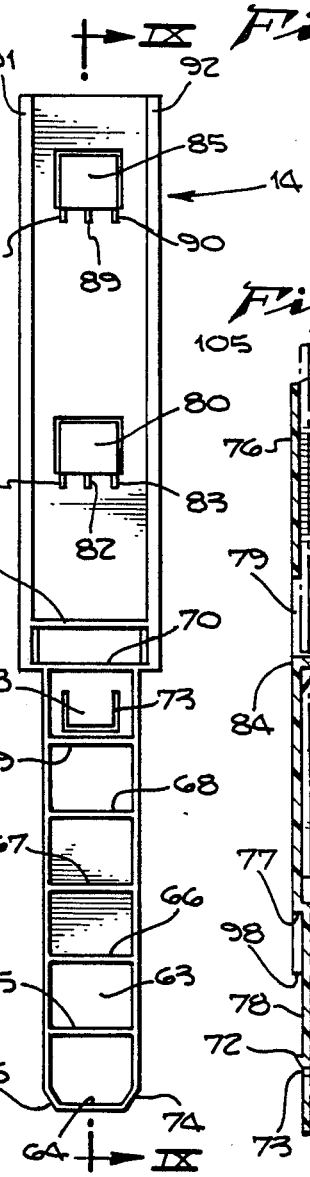
Fig. 13.
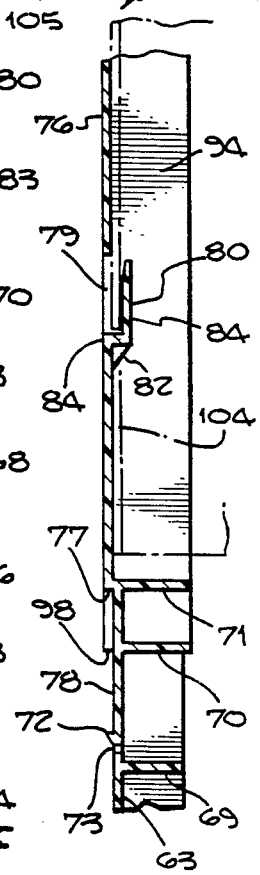
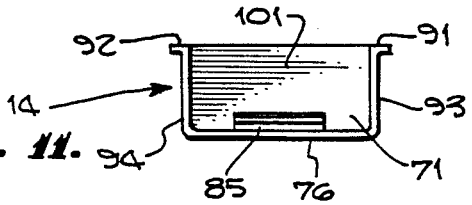
Fig. 11.

DISPLAY STAND

BACKGROUND OF THE INVENTION

1. Field of the Invention

The invention relates to display stands; and, more particularly, to a knockdown display stand for mounting a removable display board in an upright position.

2. Description of the Prior Art

Display stands are well known in the art. Such stands are used to mount a display board in an upright position presenting a visual or informational display to the viewer. Such stands should be sturdy, easy to assemble and knock down with the display boards easily removable therefrom. Generally, such stands should not be too complicated so that low level employees of stores or the like can easily assembly them. The width of such stands should be relatively inexpensive, and they should be sturdy enough to withstand moisture and the like encountered during ordinary use, such as wet floors and the like.

There is thus a need for a display stand which is easy to set up and take down, adjustable in width, relatively inexpensive yet sturdy enough for use in wet environments.

SUMMARY OF THE INVENTION

It is an object of this invention to provide an improved display stand for displaying a removable display board in an upright manner.

It is a further object of this invention to provide such a display stand which is adjustable in width, can present the board at an angle, and is easily and quickly assembled and knocked down.

These and other objects are preferably accomplished by providing a stand which can present a display board in a generally upright position The board is retained to the stand but quickly and easily removable therefrom. The stand has a pair of spaced Y-shaped base members, the shorter legs resting on the floor with the longer leg upright. A tube interconnects the two spaced base members and the uprights each have vertical channels for receiving the board therein.

BRIEF DESCRIPTION OF THE DRAWING

FIG. 8 is a plan front view of the one of the extender arms alone of the stand of FIG. 1;

FIG. 9 is a view of the arm of FIG. 8 taken along lines IX—IX thereof;

FIG. 10 is a rear plan view of the arm of FIGS. 8 and 9;

FIG. 11 is a view taken along lines XI—XI of FIG. 10;

FIG. 13 is a view similar to a portion of the view shown in FIG. 9, showing in phantom the display board of FIG. 12 disposed thereon.

DESCRIPTION OF THE PREFERRED EMBODIMENT

Figure 1:
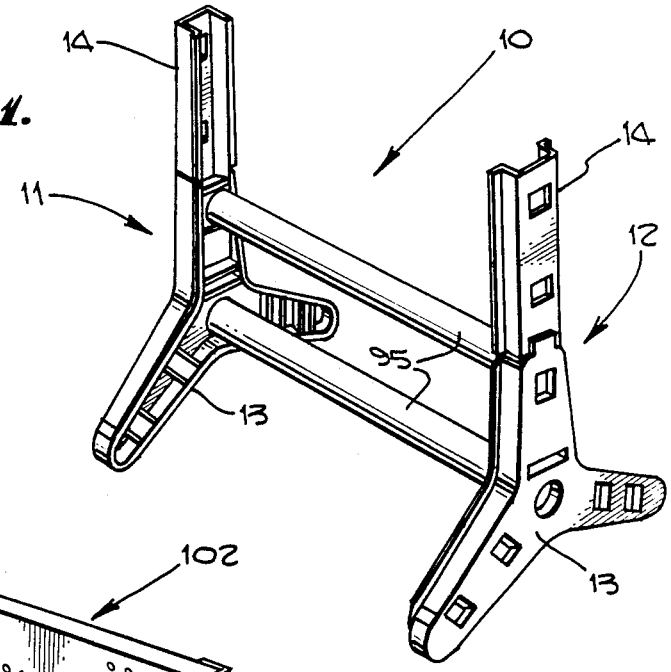
FIG. 1 is a perspective view of the display stand alone of the invention.
Figure 3:
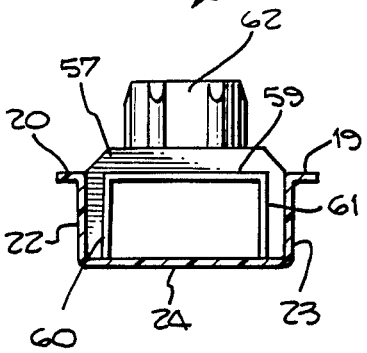
FIG. 3 is a view taken along lines III—III of FIG. 2.
Figure 4:
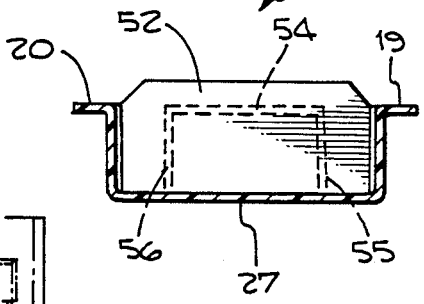
FIG. 4 view taken along lines IV—IV of FIG. 2.
Figure 6:
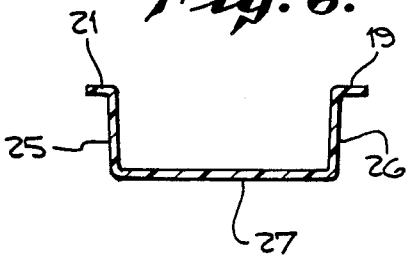
FIG. 6 view taken along lines VI—VI of FIG. 2.
Figure 7:
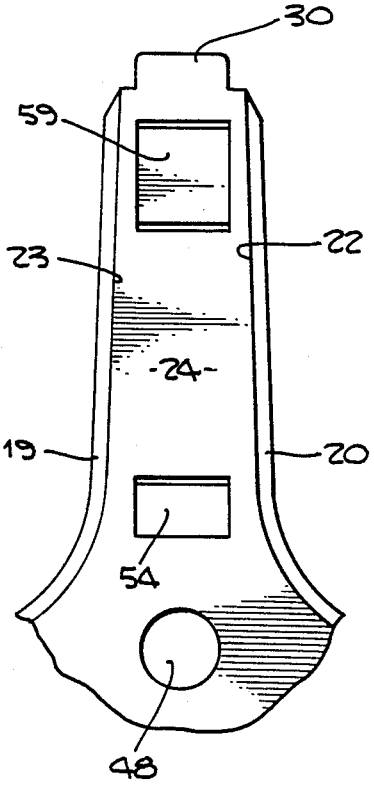
FIG. 7 is a rear elevational view of a portion of the base alone of FIG. 2.

Referring now to FIG. 1 of the drawing, a display stand 10 is shown comprised of a pair of spaced base supports 11, 12 interconnected by tubes 95. Each base support 11, 12 is comprised of a base 13 (see FIG. 2) and an upstanding elongated extender arm 14 (see FIG. 8). Base 13 (FIG. 2) is shown resting on surface 15 and is a tri-legged member having legs 16, 17 and 18. A peripheral flange 19 (FIG. 2—see also FIG. 4) extends along one side of leg 17 and along one side of leg 16. A like flange 20 extends along the other side of leg 19 and one side of leg 18. A third peripheral flange 21 (see also FIG. 6) extends along the outside of legs 16 and 18 and, as shown, rests on surface 15. As seen in FIG. 3, the flanges 19, 20, side walls 22, 23 and interconnecting back wall 24 (see also FIG. 7) may be one integral generally U-shaped piece, preferably molded from a suitable plastic material. As seen in FIG. 6, flanges 19, 21 extend from side walls 25, 26 interconnected by back wall 27 to form an integral generally U-shaped piece, also of plastic or similar material. A cross-section through leg 18 is identical and the side walls and back walls merge into a single unitary Y-shaped member as shown.

Legs 16, 18 are rounded, as at rounded ends 28, 29, respectively, at their terminal ends whereas leg 17 terminates in a reduced end 30. A pair of spaced cross-ribs 31, 32 are provided adjacent rounded end 28 of leg 16 and a like pair of spaced cross-ribs 33, 34 are provided adjacent rounded end 29. The spaces between ribs 31, 32 and ribs 33, 34 may be open areas with an overlying flange, such as flange 35 interconnected to leg 16 at flanges 36, 36' and flange 37 interconnected to leg 18 at flanges 38, 38'.

Spaced cross-ribs 39, 40 may also be provided at the intersection of leg 16 with leg 17 with spaced cross-ribs 41, 42 provided at the intersection of leg 18 with leg 17. The areas between ribs 39, 40 and ribs 41, 42 may also be open with overlying flanges, such as flange 43 coupled to leg 16 via flanges 44, 44' and flange 45 coupled to leg 18 via flanges 46, 46'.

A raised boss 47 (see also FIG. 5) is provided at the intersection of legs 16, 17 and 18 having a bottom wall 48 (FIG. 5) integral with a cylindrical wall 49 integral with back wall 24. A cylindrical member 50 is integral with wall 48 and a plurality of spaced elongated ribs 51 (FIG. 2) extend about the exterior of member 50.

A pair of spaced walls 52, 5 (FIG. 5) are provided on wall 24 with an overlying flange 54 connected to wall 52 and overlying open area 56.

A pair of spaced cross-ribs 57, 58 (FIG. 2) are provided on leg 17 adjacent reduced end 30. As particularly seen in FIG. 5, the area therebetween is open with an overlying flange 59 connected to back wall 24 via flanges 60, 61. As particularly seen in FIG. 5, a cylindrical boss 62 extends from flange 59 having a plurality of spaced elongated ribs 63 on the outer surface thereof.

Any suitable dimensions or angular relationships of parts may be used. For example, the angle x (FIG. 2) between the central axis of leg 17 and each leg 18 and 16 may be about 64.5°. The radius of curvature of flanges 19, 20 and 21 may be about 3". The distance from the center of boss 47 to the tip of each leg 16–18 may be about 10". Each leg may taper, e.g., at an angle of about 2°, outwardly from the intersections thereof to an overall width of about 2.15" (exclusive of the outer peripheral flanges 19–21). Flanges 19–21 may be about ¼" wide.

The thickness of each base 13 may be about 1" (exclusive of the bosses 47, 62) and the material comprising base 13 may be of any suitable material, such as heavy cardboard, metal, etc. However, plastic is preferred, as for example, polypropylene.

As seen in FIG. 8, each extender arm 14 (one shown in FIG. 3) has a top wall 63 (FIG. 10) and a first downwardly extending end wall 64 with spaced partition walls 65 to 71. A U-shaped rib 72 is provided on wall 63 surrounding an opening 73 therethrough (see FIG. 9) thus forming a flap 78. The forward end of arm 14 at end wall 64 may taper or have cut-off corners 74, 75 as shown. As seen in FIG. 8, top wall 63 is integral with a wider top wall portion 76 which is wider than top wall 63 so that the area y (FIG. 10) forms an insertible tab as will be discussed. As seen in FIG. 9, the intersection of wall 63 with wall 76 forms a shoulder 77.

An opening 79 (see FIG. 9) is provided through wall 76 and a flap 80 overlies opening 79. Trapezoidally-shaped strengthening ribs 81–83 (FIGS. 8 and 9) may extend from flap 80, which is integral with and extends normal from a flange portion 84 (FIG. 9) integral with wall 76. A second flap 85 is provided spaced from flap 80 overlying opening 86 (FIG. 9) and secured to and integral with a flange portion 87. Ribs 88–90, similar to ribs 81–83, may be provided as seen in FIG. 8.

As seen in FIGS. 10 and 11, a pair of elongated flanges 91, 92 extend from side walls 93, 94, respectively. Each arm 14 may be of any suitable length, such as 17.3" long or so. The distance y may be about 7" or so and, as seen in FIG. 5, the distance z, as will be appreciated, is similarly about 7" long.

In operation, two bases 13 are disposed on supporting surface 15 with bosses 47, 62 facing each other. Elongated tube 95, which is preferably a hollow cylindrical tube of an easily cut material, such as cardboard, is assembled to each base 13 by slipping the open ends over bosses 47. That is, tube 95 slips over the ribbed bosses 47. Although only a single tube 95 may be necessary, a second tube 95 may be slipped over bosses 62 as seen in FIG. 1.

Figure 5:
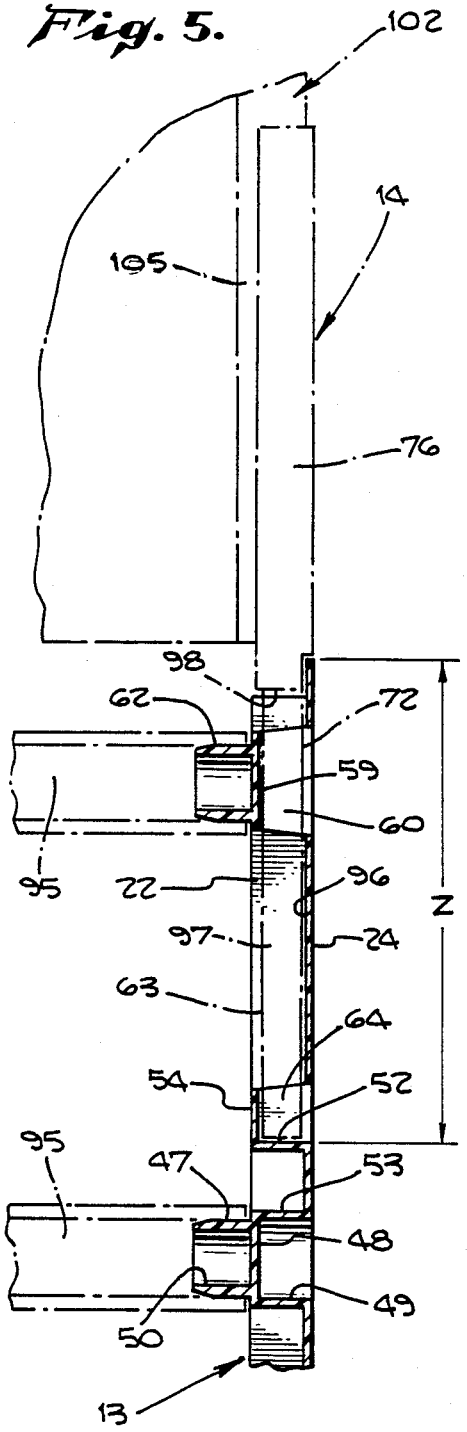
FIG. 5 is a view, partly in phantom, taken along lines V—V of FIG. 2.

As seen in FIG. 5, a channel 96, open at the top, is formed between wall 59 of boss 62, wall 52 and back wall 24. The tongue 97 (FIG. 10) of each arm 14, between the end wall 64 and shoulder 98, is inserted into channel 96 until end 64 abuts against flange 52. The portion 99 of each arm 14, between shoulder 98 and terminal end 100, FIG. 10, extends above each base 11, 12 and the arms 14 are oriented so that open areas 101 (see FIGS. 1 and 9) face each other.

Figure 12:
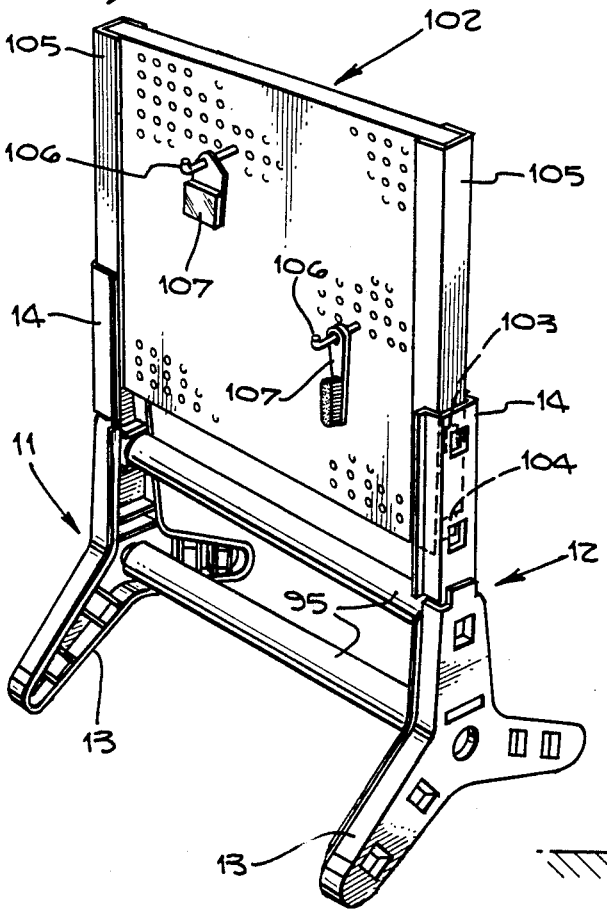
FIG. 12 is a perspective view similar to FIG. 1 showing a second tube used to interconnect the bases and a display board disposed on the assembled stand.

It can be appreciated that the inner open areas 101 between end 100 and flange 71 also form channels. As seen in FIG. 12, a display board 102, which is preferably hollow and generally of cardboard, plastic or other suitable material, having a generally rectangular configuration forming elongated rectangular side walls 105, is slid within the opposed channels 101 in each arm 14. As seen in dotted lines in FIG. 12, a plurality of rectangular spaced openings, such as openings 103, 104, are provided along each side wall 105 all the way through walls 105. The tabs or flaps 80, 85, (see FIG. 13) which extend upwardly, slide into openings 103, 104. That is, the spacing between openings 103, 104 is related to the spacing between flaps 80, 85 so that flap 80 enters opening 104 and flap 85 enters opening 103, the wall of each opening 103, 104 abutting against flange portions 87, 84, respectively. Thus, board 102 is retained to stand 10 and held in an upright position.

Tubes 95 can be quickly and easily cut to size to vary the spacing between opposed bases 13 to accommodate display boards of various widths. The entire stand is economical and inexpensive to manufacture, and can quickly and easily be put up and taken down by unskilled workers.

The board 102 can be perforated so that hooks 106 (FIG. 12) can be inserted therein, as is well known in the art, to display merchandise 107.

Figure 14:
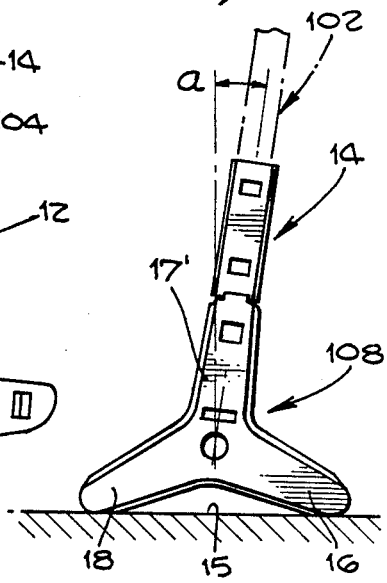
FIG. 14 is a vertical view of a modified base in accordance with the teachings of the invention.
Figure 2:
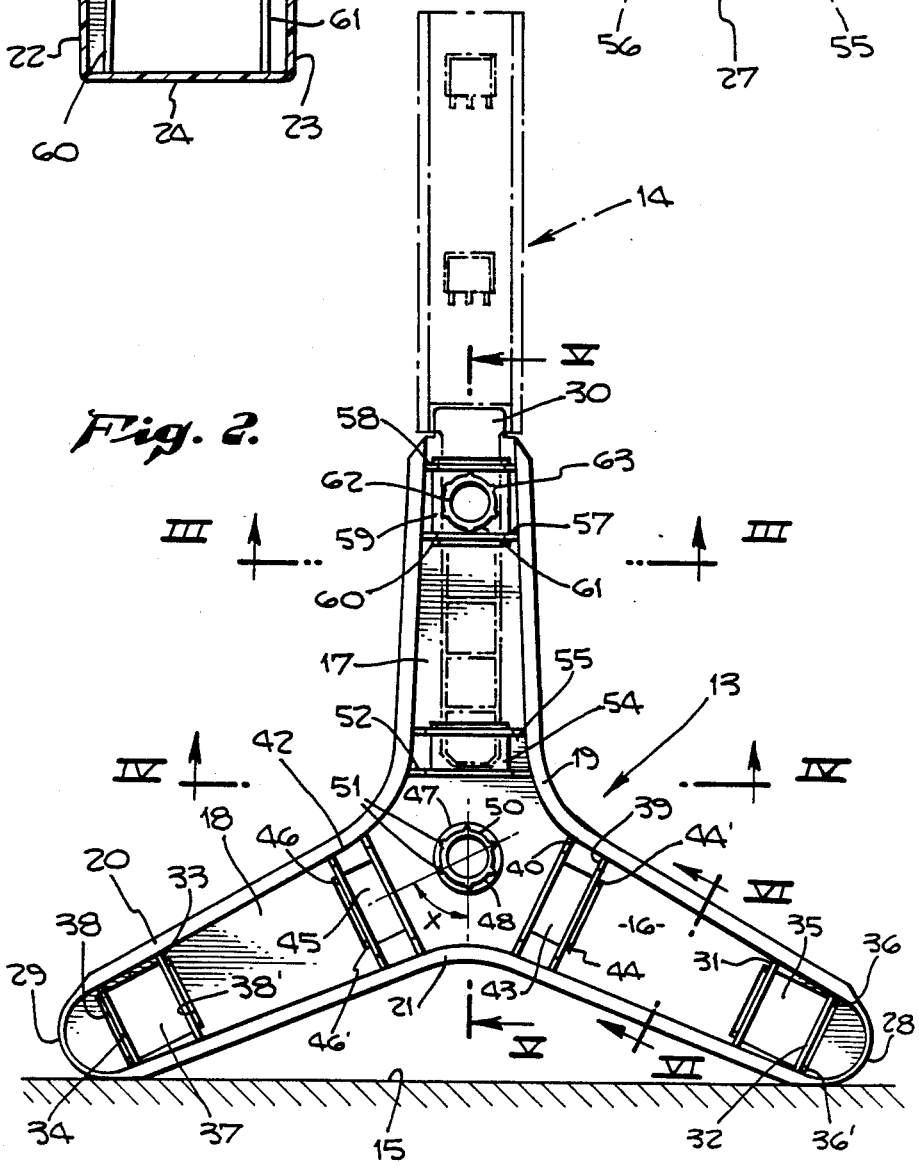
FIG. 2 a side elevational view of one of the bases alone of the stand of FIG. 1 showing an extender arm mounted thereto in phantom.

The parts in FIGS. 2 and 3 can be of plastic and reused. Since base 13 rests on a supporting surface, it is not affected by wet floors and the like and thus not subject to rotting and getting soiled as when floors in stores or the like are wet mopped. Also, as seen in FIG. 14, wherein like numerals refer to like parts of the embodiment of FIG. 2, leg 17', otherwise identical to leg 17, may be angled, such as at an angle a of about 7½°, so that a slight slope is presented of the display board 102 insertible therein.

Although board 102 may have round spaced holes for receiving conventional hooks, board 102 may have spaced elongated slots therein for receiving display means as disclosed in my U.S. Pat. No. 4,671,417.

It can be seen that there is disclosed a unique and easily assembled and knocked down display stand. Although I have disclosed a specific embodiment thereof, obvious variations may occur to an artisan and the scope of the invention should be limited only by the appended claims.

I claim:

1. A display stand comprising:

a pair of spaced bases, each of said bases having at least three legs, said legs forming a Y-shaped configuration with a boss at the junction of two of said legs, said boss extending outwardly away from the plane of said base, a channel formed interiorly of the third leg of said Y-shaped configuration extending away from said two of said legs, said channel being formed by a rear wall of said base and interconnecting spaced side walls extending along each side of said third leg open at the top with a wall extending traverse of said channel adjacent said boss, said bases being disposed on a supporting surface whereby said bosses face each other and said third leg extends upwardly;

an elongated member interconnecting said bosses;

an extension member having an elongated tongue slidably mounted into each channel of each base between said bosses and the rear wall of each of said bases, each of said extension members having an integral elongated portion having a rear wall and interconnected side walls forming a channel open at the terminal end thereof, said last-mentioned channels facing each other in the same direction as said bosses, and a plurality of spaced tabs along said last-mentioned channel extending inwardly thereof and in a direction toward said open terminal end thereof whereby a display board having spaced slots can be inserted into said last-mentioned channels with said tabs entering said slots to hold a board in position on said stand.

2. In the stand of claim 1 wherein sad third leg is at an angle from the vertical when said first two legs rest on a supporting surface.

3. In the stand of claim 2 wherein said angle is about $7\frac{1}{2}°$.

4. In the stand of claim 1 wherein said bosses are generally cylindrical and said elongated member is a hollow tube frictionally fitting over said bosses.

5. In the stand of claim 4 wherein said bosses are ribbed.

6. In the stand of claim 4 wherein said tube is cardboard material.

7. In the stand of claim 1 including a hollow rectangular display board having spaced rectangular side walls with a plurality of slots through said last-mentioned side walls, the spacing between said slots being related to the spacing between said tabs, said tabs being disposed in said slots.

8. In the stand of claim wherein the angle between the central axis of said first two legs is about 129°.

9. In the stand of claim including a second boss on each of said third legs adjacent the upper end thereof, said second bosses extending in a direction toward each other.

10. In a display stand, a base member of one-piece construction having at least three legs being substantially identical in length and forming a Y-shaped configuration with an outwardly protruding boss at the junction of two of said legs, said boss extending outwardly away from the plane of said base member, a channel formed interiorly of the third leg of said Y-shaped configuration extending away from said two of said legs and extending substantially the full length of said third leg, said channel being formed by a rear wall of said base member and interconnecting spaced side walls extending along each side of said third leg open at the top with a wall extending traverse of said channel adjacent said boss providing a stop in said channel adjacent said boss.

11. In the display stand of claim, said base member including an extension member having an elongated tongue slidably mounted into the channel of said base member between said boss and the rear wall of said base member, said extension member having an integral elongated portion having a rear wall and interconnected side walls forming a channel open at the terminal end thereof, and a plurality of spaced tabs along said last-mentioned channel extending inwardly thereof and in a direction toward said open terminal end.

12. In a display stand, a base member having at least three legs, said legs forming a Y-shaped configuration with a boss at the junction of two of said legs, said boss extending outwardly away from the plane of said base member, a channel formed interiorly of the third leg of said Y-shaped configuration extending away from said two of said legs, said channel being formed by a rear wall of said base member and interconnecting spaced side walls extending along each side of said third leg open at the top with a wall extending traverse of said channel adjacent said boss, said base member including an extension member having an elongated tongue slidably mounted into the channel of said base member between said boss and the rear wall of said base member, said extension member having an integral elongated portion having a rear wall and interconnected side walls forming a channel open at the terminal end thereof, and a plurality of spaced tabs along said last-mentioned channel extending inwardly thereof and in a direction toward said open terminal end.

* * * * *